US009670564B2

(12) United States Patent
Johnson et al.

(10) Patent No.: US 9,670,564 B2
(45) Date of Patent: Jun. 6, 2017

(54) LOW-TEMPERATURE DISPERSION-BASED SYNTHESES OF SILVER AND SILVER PRODUCTS PRODUCED THEREBY

(71) Applicant: CORNING INCORPORATED, Corning, NY (US)

(72) Inventors: Benedict Yorke Johnson, Horseheads, NY (US); Samuel Odei Owusu, Horseheads, NY (US)

(73) Assignee: CORNING INCORPORATED, Corning, NY (US)

( * ) Notice: Subject to any disclaimer, the term of this patent is extended or adjusted under 35 U.S.C. 154(b) by 104 days.

(21) Appl. No.: 14/424,241

(22) PCT Filed: Aug. 29, 2013

(86) PCT No.: PCT/US2013/057293
§ 371 (c)(1),
(2) Date: Feb. 26, 2015

(87) PCT Pub. No.: WO2014/036261
PCT Pub. Date: Mar. 6, 2014

(65) Prior Publication Data
US 2015/0211090 A1 Jul. 30, 2015

Related U.S. Application Data

(60) Provisional application No. 61/695,428, filed on Aug. 31, 2012.

(51) Int. Cl.
*C22B 11/00* (2006.01)
*C22B 3/16* (2006.01)
(Continued)

(52) U.S. Cl.
CPC ..... *C22B 11/04* (2013.01); *B22F 1/0018* (2013.01); *B22F 9/24* (2013.01); *C22B 3/16* (2013.01); *C22B 11/02* (2013.01); *C22C 5/06* (2013.01)

(58) Field of Classification Search
CPC ..... C22B 11/04; C22B 3/16; B22F 1/0018; B22F 9/24
See application file for complete search history.

(56) References Cited

U.S. PATENT DOCUMENTS 2,005,018 A 6/1935 West et al.
3,334,995 A 8/1967 Gaspar
(Continued)

FOREIGN PATENT DOCUMENTS

CN 1718330 A 1/2006
CN 101065205 10/2007
(Continued)

OTHER PUBLICATIONS

"Ethylene Glycol : Systemic Agent", Centers for Disease Control and Prevention, updated Nov. 20, 2014.*
(Continued)

*Primary Examiner* — George Wyszomierski
*Assistant Examiner* — Tima M McGuthry Banks
(74) *Attorney, Agent, or Firm* — Jie Gao

(57) ABSTRACT

Described herein are methods of making metallic or elemental silver. These methods generally include a step of forming a reaction dispersion that includes a silver-containing compound, an organic acid, and a solvent that includes an alcohol, followed by mixing the reaction dispersion for a time and at a temperature effective to form a reaction product that includes metallic silver from a cationic silver
(Continued)

species of the silver-containing compound. Also described herein are metallic or elemental silver produced by these methods.

16 Claims, 15 Drawing Sheets

(51) Int. Cl.

| | |
|---|---|
| ***B22F 1/00*** | (2006.01) |
| ***B22F 9/24*** | (2006.01) |
| ***C22B 3/00*** | (2006.01) |
| ***C22B 11/02*** | (2006.01) |
| ***C22C 5/06*** | (2006.01) |

(56) References Cited

U.S. PATENT DOCUMENTS

| | | | | |
|---|---|---|---|---|
| 3,649,250 | A | 3/1972 | Dorenfeld et al. | |
| 4,039,327 | A | 8/1977 | Dietz, Jr. et al. | |
| 4,078,918 | A | 3/1978 | Perman | |
| 4,131,455 | A | 12/1978 | Edwards et al. | |
| 4,293,332 | A | 10/1981 | Wang et al. | |
| 4,445,935 | A | 5/1984 | Posey et al. | |
| 4,496,470 | A | 1/1985 | Kapiloff et al. | |
| 4,539,041 | A | 9/1985 | Figlarz et al. | |
| 5,089,097 | A | 2/1992 | Goto et al. | |
| 5,389,122 | A | 2/1995 | Glicksman | |
| 5,715,387 | A | 2/1998 | Barnstijn et al. | |
| 5,885,535 | A | 3/1999 | Asano et al. | |
| 6,231,637 | B1 | 5/2001 | Tayama et al. | |
| 6,277,290 | B1 | 8/2001 | Ren et al. | |
| 2004/0159185 | A1 | 8/2004 | Shamblen et al. | |
| 2005/0183543 | A1* | 8/2005 | Sasaki | B22F 1/0014 75/371 |
| 2006/0090599 | A1 | 5/2006 | Goia et al. | |
| 2006/0159603 | A1* | 7/2006 | Vanheusden | B22F 1/0018 423/1 |
| 2007/0056402 | A1* | 3/2007 | Cho | B22F 1/0014 75/362 |
| 2009/0236567 | A1 | 9/2009 | Ogi et al. | |
| 2009/0242231 | A1* | 10/2009 | Miyagisima | B22F 1/0022 174/68.1 |
| 2010/0065789 | A1 | 3/2010 | Sato | |
| 2010/0276647 | A1 | 11/2010 | Irizarry | |
| 2012/0225126 | A1 | 9/2012 | Geckeler et al. | |

FOREIGN PATENT DOCUMENTS

| | | | |
|---|---|---|---|
| CN | 101774026 | | 4/2011 |
| CN | 102205421 | A | 10/2011 |
| CN | 102407342 | B | 6/2013 |
| DE | 4209180 | | 9/1993 |
| JP | 2003293049 | | 10/2003 |
| JP | 2006348375 | | 12/2006 |
| JP | 2004190135 | | 7/2007 |
| JP | 2009144197 | A * | 7/2009 |
| JP | 2011-080094 | A * | 4/2011 |
| RO | 116096 | | 10/2000 |
| RU | 2170277 | | 7/2001 |
| RU | 2258091 | | 8/2005 |

OTHER PUBLICATIONS

Kakihara, Yasuo. JP 2009-144197 A published Jul. 2009. machine translation.*

Machine Translation of Kakihara et al. JP 2011-080094 A published Apr. 2011.*

Patent Cooperation Treaty International Notification of Transmittal of the International Preliminary Report of Patentability Report on Patentability (Chapter I of the Patent Cooperation Treaty) of the International Searching Authority, international application No. PCT/US2013/057293: mailing date Mar. 12, 2013, 10 pages.

Patent Cooperation Treaty International Notification of Transmittal of the International Search Report and The Written Opinion of the International Searching Authority, international application No. PCT/US2013/057293: mailing date Nov. 22, 2013, 13 pages.

Chang Gun Lee, "Synthesis of High-Purity Silver Colloids using a Thermal Decomposition Method," Metals and Materials International, vol. 14, No. 2, Apr. 26, 2008, pp. 189-192.

Qin y et al, "Size Control over Spherical Silver Nanoparticles by Ascorbic Acid Reduction." Colloids and Surfaces. A, Physicachemical and Engineering Aspects, Elsevier, Amsterdam, NL, vol. 372, No. 1-3, Dec. 3, 2010, pp. 172-176.

Dennis Steinigeweg and Sebastian Schlucker, "Monodispersity and Size Control in the Synthesis of 20-100 nm Quasi-Spherical Silver Nanoparticles by Citrate and ascorbic Acid Reduction in Glycerol Water Mixtures." Chem. Commun., 2012, 48, pp. 8682-8684.

Anna Zielinska, "Preparation of silver nanoparticles with controlled particle size", vol. 1, No. 2, Nov. 1, 2009, pp. 1560-1566, XP055086848.

Patent Cooperation Treaty International Notification of Transmittal of the International Search Report and The Written Opinion of the International Searching Authority, international application No. PCT/US2013/057237: mailing date Nov. 22, 2013, 13 pages.

Patent Cooperation Treaty International Notification of Transmittal of the International Search Report and The Written Opinion of the International Searching Authority, international application No. PCT/US2013/057304: mailing date Nov. 22, 2013, 13 pages.

Blanchard et al; "Final Report: Recovery of Silver From CEPOD Anolyte Solutions" ; Sep. 1994; Pacific Northwest Laboratory; 31 Pages.

CN201380051315.2 Search Report Dated Dec. 24, 2015; 2 Pages.

DE112013004232.0 Office Action Dated Nov. 11, 2015.

Debnath et al; Solid-State Synthesis of Silver Nanoparticles At Room Temperature: Poly (Vinylpyroolidone) As a Tool; Macromolecular Rapid Communications (2010), vol. 31, Issue 6, pp. 549-553.

International Search Report and Written Opinion of The International Searching Authority; PCT/US2013/057237; Mailed Nov. 22, 2013.

Sinha et al; "Preparation of Silver Powder Through Glycerol Process"; Bull. Mater. Sci. vol. 28, No. 3, Jun. 2005, pp. 213-217.

Tatykhanova et al; "Preparation of Gold and Silver Nanoparticles by Mechanical Activation"; Nanomaterials: Applications and Properties (NAP-2011) vol. 1, Part 1, pp. 165-168.

Yang et al; "Study of the Solid Reaction of Gold Compounds"; Chemical World, (3), Mar. 25, 1997; pp. 126-127.

Zhouxiang et al; "A Method to Recover Silver From Wast X-Ray Films With Spent Fixing Bath"; Hydrometallurgy, 92 (2008) 148-151.

International Search Report and Written Opinion of The International Searching Authority; PCT/US2013/057293; Mailed Nov. 22, 2013.

Chen et al; "Key Factors in Chemical Reduction by Hydrazine for Recovery of Precious Metals"; Chemosphere, 49, 2002, 363-370.

Guo et al; "Preparation and Dispersive Mechanism of Highly Dispersive Ultrafine Silver Powder", Applied Surface Science, vol. 256, No. 22, Sep. 1, 2010, pp. 6683-6687.

Songping et al; "Preparation of Ultrafine Silver Powder Using Ascorbic Acid As Reducing Agent and Its Application in MLCI" Materials Chemistry and Physics, Elsevier SA, Switzerlnd, Taiwan Republic of China, vol. 89, No. 23, Feb. 15, 2005, pp. 423-427.

Gonzalez et al; "Silver Recovery From Acidic Solutions by Formation of Nanoparticles and Submicroparticles of Ag on Microfiltration Membranes"; Jul. 7, 2011, www.intechopen.com; Mass Transfer—Advanced Aspects; 23 Pages.

Perman; "Recovery of Silver From Silver Chloride Residues"; (1979), Talanta, vol. 26, pp. 603-607.

Alqadi et al., pH effect on t'1e aggregation of silver nanoparticles synthesized by chemical reduction, Materials Science-Poland, 32(1), 2014, 107-111.

Bouis, Paul A. "Reagents, Buffers, and Indicators." Reagents, Buffers, and Indicators (2006): 95-106. ACS Publication. American Chemical Society.

(56) References Cited

OTHER PUBLICATIONS

Lanying et al; "Research on New Process of Recovering High Purity Silver From Low Silver-Contaning Waste"; Hunan Non-Ferrous Metal; vol. 10, No. 1; pp. 38-41 Feb. 1994.
Sondi et al., Preparation of highly concentrated stable dispersions of uniform silver nanoparticles, Journal of Colloid and Interface Science, 260 (2003) 75-81.
Perman; "Recovery of Silver From Silver Chloride Residues"; Talanta, vol. 26, pp. 603-607, Dated Nov. 27, 1978.

* cited by examiner

LOW-TEMPERATURE DISPERSION-BASED SYNTHESES OF SILVER AND SILVER PRODUCTS PRODUCED THEREBY

CROSS-REFERENCE TO RELATED APPLICATION

This application claims the benefit of priority under 35 U.S.C. §365 of International Patent Application Serial No. PCT/US13/57293 filed on Aug. 29, 2013, designating the United States of America, which in turn, claims the benefit of priority under 35 U.S.C. §119 of U.S. Provisional Application Ser. No. 61/695,428 filed on 31 Aug. 2012 the contents of which are relied upon and incorporated herein by reference in their entirety as if fully set forth below.

TECHNICAL FIELD

The present disclosure relates generally to the production of metallic (i.e., elemental) silver. More particularly, the various embodiments described herein relate to methods of making metallic silver at low temperatures and with minimal solvent usage, as well as to the metallic silver produced therefrom.

BACKGROUND

Silver is used extensively for industrial purposes owing to its exceptional properties (e.g., high electrical and thermal conductivity, malleability, ductility, and its resistance to corrosion). To illustrate, common uses for, or products incorporating, silver or silver compounds include photographic materials, electroplating, electrical conductors, dental alloys, solder and brazing alloys, paints, jewelry, coins, mirror production, antibacterial agents, and water purification.

The range of methods used to produce metallic silver include chemical, physical (atomization and milling), electrochemical, and thermal decomposition techniques. Each type of method generally produces particles with a characteristic morphology and purity that ultimately govern its functional properties. Among the various existing techniques, those based on chemical precipitation offer distinct advantages in terms of particle morphology, manufacturing cost, and scale-up efficiency for mass production.

Precipitation of metallic silver in solution generally involves a chemical reduction in which a dissolved silver salt species is treated with a reducing agent to generate metallic silver, which precipitates out from the solution. Though existing methods are relatively simple and incorporate quick reduction reactions, the reducing agents employed for such methods are frequently toxic and/or carcinogenic, and can cause safety and health problems when implemented in high volumes.

To address these concerns, methods that use alcohols or polyols have been developed. These methods generally involve the reduction of a silver salt species using a heated alcohol or polyol, which serves as both the reducing agent and solvent, in the presence of protecting ligands. A major drawback of these alcohol or polyol methods is that large quantities of organic solvents are used to dissolve the metal salts, and thus large quantities of chemical waste are generated.

There accordingly remains a need for improved technologies that can be used to produce metallic silver. It would be particularly advantageous if these methods were more simple, less chemical-intensive, and less expensive, while also being amenable to commercial-scale production of metallic silver. It is to the provision of such technologies that the present disclosure is directed.

BRIEF SUMMARY

Described herein are various methods of making metallic silver, as well as silver particles produced thereby.

One type of method of making metallic silver includes disposing a silver-containing compound and an organic acid in a solvent that includes an alcohol to form a reaction dispersion, such that a concentration of the organic acid and alcohol is equimolar to or in a stoichiometric excess of a concentration of a cationic silver species in the silver-containing compound, and such that a mass of the solvent in the reaction dispersion is less than or equal to a combined mass of the silver-containing compound and the organic acid. This type of method can also include the step of mixing the reaction dispersion for a time that is sufficient to produce a reaction product that includes metallic silver from the cationic silver species of the silver-containing compound. This type of method can also include an optional step of heating the reaction dispersion, which, when implemented, can occur before, after, or at the same time as the mixing step.

In certain embodiments of this type of method, the silver-containing compound can include silver nitrate, silver nitrite, silver oxide, silver sulfate, silver phosphate, a silver halide, or a mixture thereof. Similarly, in certain overlapping or non-overlapping embodiments of this type of method, the organic acid can include lactic acid, citric acid, oxalic acid, ascorbic acid, fumaric acid, maleic acid, or a mixture thereof.

In certain implementations of this type of method, the alcohol is a monohydric alcohol. When the alcohol is a monohydric alcohol, there are cases when the mixing is conducted at room temperature, such that the optional heating step is not implemented. In contrast, when the alcohol is a monohydric alcohol, there are cases where the heating step is implemented, and the reaction dispersion is heated to a temperature of less than or equal to a boiling temperature of the monohydric alcohol.

In certain implementations of this type of method, the alcohol is a polyhydric alcohol. When the alcohol is a polyhydric alcohol, there are cases when the optional heating step occurs during the mixing step, and the reaction dispersion is heated to a temperature of less than or equal to a boiling temperature of the polyhydric alcohol.

In some situations, the optional heating step occurs after the mixing step, and the reaction dispersion is heated to a temperature of less than or equal to a boiling temperature of the alcohol.

There are implementations of this type of method where the time of the mixing step can be about 5 minutes to about 3 hours.

In certain implementations, this type of method can include a step of recovering the metallic silver from the reaction product. In one such implementation, the recovering entails disposing the reaction product in a solvent, such that the metallic silver is dispersed in the solvent and a remaining portion of the reaction product is dissolved in the solvent, followed by separating the metallic silver from the solvent with the remaining portion of the reaction product dissolved therein.

When the optional heating step and the recovering step are implemented, this type of method can further involve cooling the reaction product before the recovering step.

The metallic silver produced in some implementations of this type of method can be produced in a fractional yield of greater than 90 percent.

One type of metallic silver product can be produced in accordance with one or more of the embodiments of the type of method described directly above. The metallic silver product can have less than 20 parts per million of a non-silver metal. In addition, or in the alternative, the metallic silver product can have an average particle size of less than or equal to about 1 micrometer.

Another type of method of making metallic silver includes disposing a silver-containing compound and an organic acid in an alcohol to form a reaction dispersion, such that a concentration of the organic acid and alcohol is equimolar to or in a stoichiometric excess of a concentration of a cationic silver species in the silver-containing compound, and such that a mass of the alcohol in the reaction dispersion is less than or equal to a combined mass of the silver-containing compound and the organic acid. This type of method can also include a step of mixing the reaction dispersion for a time that is sufficient to produce a reaction product that includes metallic silver from the cationic silver species of the silver-containing compound. This type of method can also include a step of disposing the reaction product in a solvent, such that the metallic silver is dispersed in the solvent and a remaining portion of the cooled reaction product is dissolved in the solvent followed by separating the metallic silver from the solvent with the remaining portion of the reaction product dissolved therein.

In some implementations of this type of method, the silver-containing compound can be silver nitrate, the organic acid can be ascorbic acid, the alcohol can be a monohydric alcohol, and the mixing step is conducted at room temperature.

Another type of metallic silver product can be produced in accordance with one or more of the embodiments of the type of method described directly above such that the metallic silver product includes less than 20 parts per million of non-silver metals and an average particle size of less than or equal to about 1 micrometer.

It is to be understood that both the foregoing brief summary and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

Figure 1:
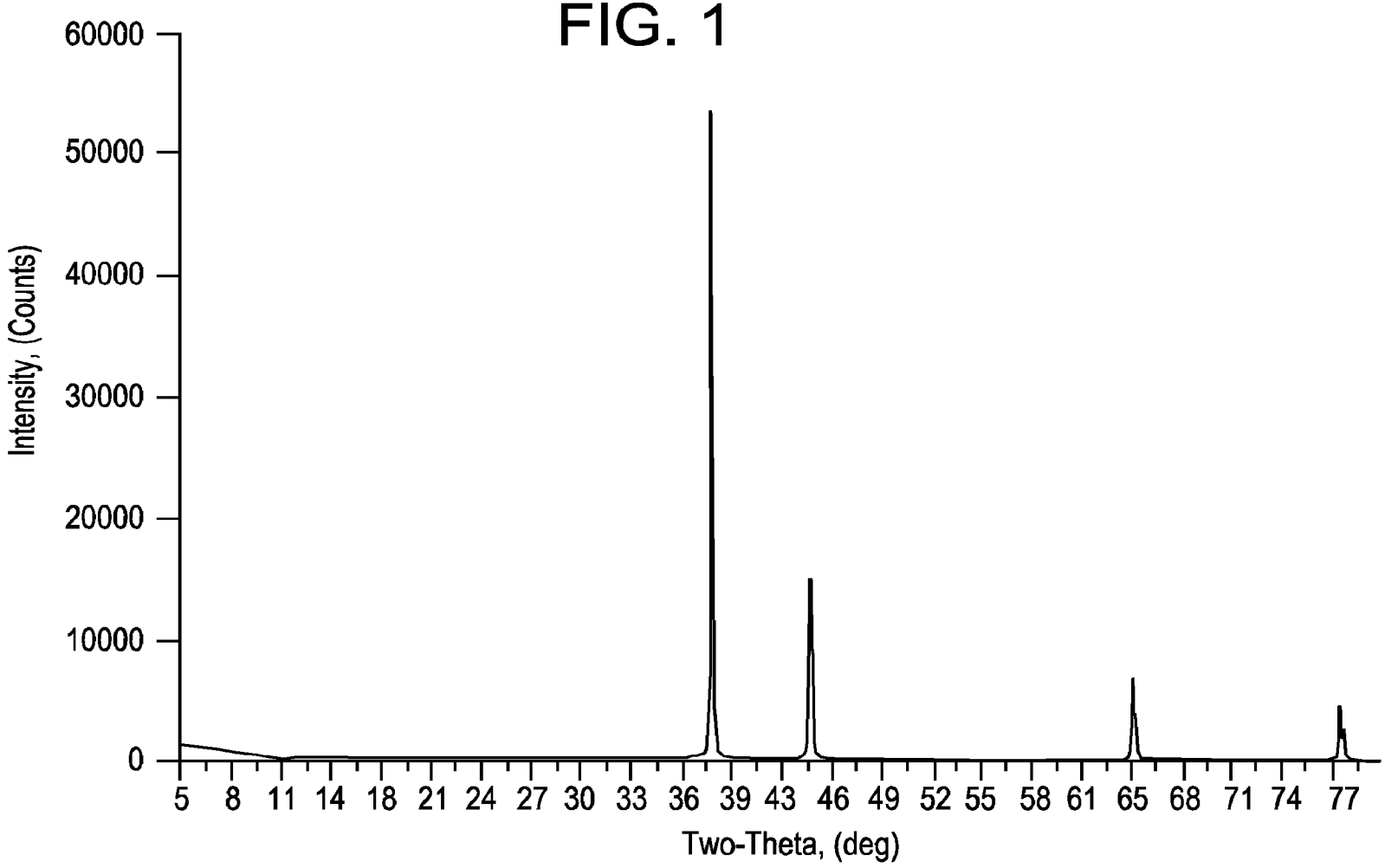
FIG. 1 is a powder X-ray diffraction pattern of the silver product produced in accordance with EXAMPLE 1.

These and other aspects, advantages, and salient features will become apparent from the following detailed description, the accompanying drawings, and the appended claims.

DETAILED DESCRIPTION

Referring now to the figures, wherein like reference numerals represent like parts throughout the several views, exemplary embodiments will be described in detail. Throughout this description, various components may be identified having specific values or parameters. These items, however, are provided as being exemplary of the present disclosure. Indeed, the exemplary embodiments do not limit the various aspects and concepts, as many comparable parameters, sizes, ranges, and/or values may be implemented. Similarly, the terms "first," "second," "primary," "secondary," "top," "bottom," "distal," "proximal," and the like, do not denote any order, quantity, or importance, but rather are used to distinguish one element from another. Further, the terms "a," "an," and "the" do not denote a limitation of quantity, but rather denote the presence of "at least one" of the referenced item.

The methods described herein are based generally on the use of the combination of an organic acid and an alcohol to reduce the cationic silver species of a solid silver-containing compound to metallic (i.e., elemental) silver at low temperatures. These methods advantageously provide mild reaction conditions and significantly less chemical waste generated than existing technologies.

These methods generally include a step of forming a reaction dispersion that includes a silver-containing compound, an organic acid, and a solvent that includes an alcohol, followed by mixing the reaction dispersion for a time and at a temperature effective to form a reaction product that includes metallic silver from a cationic silver species of the silver-containing compound. As stated above, the organic acid and alcohol serve as reducing agents by which the cationic silver species is reduced, during the mixing step, to its metallic or elemental state.

In general, formation of the reaction dispersion involves disposing a silver-containing compound and an organic acid in a solvent comprising an alcohol. This can be achieved, for example, by combining or mixing particles of the silver-containing compound with particles of the organic acid and disposing the combination directly into the solvent, by disposing particles of the silver-containing compound and the organic acid sequentially (in any order) into the solvent, by combining a first amount of solvent having particles of the silver-containing compound disposed therein with a second amount of the solvent having particles of the organic acid disposed therein, or the like. In certain implementations of these methods, if the solvent comprises a non-alcohol component and/or more than one alcohol, the reaction dispersion can be formed by disposing the silver-containing compound in one component of the ultimate or final solvent, disposing the organic acid in another component of the final solvent, and combining the final solvent components. Those skilled in the art to which this disclosure pertains will recognize that other techniques for forming the reaction dispersion can be implemented without departing from the methods described herein.

The choice of silver-containing compound is not limited to a particular composition, as the methods described herein will yield metallic silver using any of a variety of material choices. For example, the silver-containing compound can be a binary compound (e.g., silver nitrate, silver nitrite, silver oxide, silver sulfate, silver phosphate, a silver halide, or the like), a ternary or multinary compound that includes a cationic silver species and a different cationic species, a mixture thereof, or a combination comprising one or more of the foregoing silver-containing compounds and a non-silver-containing compound.

Similarly, the choice of organic acid is not limited to a particular composition, as the methods described herein will yield metallic silver using any of a variety of material choices. The only requirements for the organic acid are that it is insoluble or slightly soluble in the alcohol and that it does not melt under the conditions to which it will be exposed during the mixing step. For example, the organic acid can be lactic acid, citric acid, oxalic acid, ascorbic acid, fumaric acid, maleic acid, or the like, or a mixture thereof.

The solvent, while not limited to a particular composition, must include an alcohol. This includes monohydric alcohols and polyhydric alcohols (i.e., alcohols having more than one hydroxyl groups). Examples of suitable monohydric alcohols include methanol, ethanol, propanol, butanol, or the like, while examples of suitable polyhydric alcohols include ethylene glycol, propylene glycol, glycerol, diethylne glycol, triethylene glycol, erythritol, or the like.

In addition to an alcohol, the solvent can also include other liquids in which the silver-containing compound and the organic acid are not soluble or are slightly soluble.

In preparing the reaction dispersion, there is no particular limitation on the ratio or relative amounts of the components thereof. To ensure that all or substantially all of the cationic silver species in the silver-containing compound are reduced to metallic silver, however, the molar ratio of the sum of the organic acid and alcohol to the cationic silver species in the silver-containing compound should be greater than or equal to about 1. That is, the concentration of the organic acid and the alcohol should be about equimolar to, or in a stoichiometric excess of, the concentration of cationic silver species in the silver-containing compound.

In addition, to ensure that the reaction dispersion is indeed a dispersion, the mass of the solvent should be less than or equal to the combined mass of the silver-containing compound and the organic acid. In this manner, the reaction dispersion will have anywhere from a paste-like consistency to a slurry-like consistency.

Once the reaction dispersion comprising the silver-containing compound, the organic acid, and the solvent comprising the alcohol is formed, it can be subjected to the mixing step. In general, this involves mixing the reaction dispersion for a time and at a temperature that is sufficient to produce a reaction product that includes metallic silver as reduced from the cationic silver species of the silver-containing compound.

The physical mixing of the reaction dispersion can be effected by a number of techniques. This includes the use of stirring, mechanical shearing, shaking, sonicating, or the like. During the mixing step, actual mixing can be performed in a continuous manner or in a periodic, discontinuous manner. The degree or intensity of mixing can be range from slight agitation to violent movement or upheaval.

In many implementations, the mixing step can be conducted at room temperature. In certain implementations, however, the mixing step will also involve an optional step of heating the reaction dispersion. The reduction reaction, as induced by the mixing step, is an exothermic reaction. Thus, to avoid potential decomposition of the organic acid and/or boiling of the alcohol (which will reduce the efficiency of the reduction reaction), when the mixing step also involves the optional heating step, the temperature to which the reaction dispersion is heated should be less than or equal to about the boiling point of the alcohol. Accordingly, for any mixing step, the temperature of the reaction dispersion during the mixing step will be anywhere from room temperature to about the boiling point of the alcohol.

It should be noted that, in some implementations of the methods described herein, the optional heating step can be conducted after the mixing step. That is, the reaction dispersion can be mixed at room temperature, followed by a heating step that does not involve any mixing of the reaction dispersion. The temperature parameters provided above are applicable to these implementations.

More specifically, in implementations involving monohydric alcohols, the temperature of the reaction dispersion during the mixing step and/or optional heating step will be anywhere from room temperature to about the boiling point of the monohydric alcohol. More commonly, in these implementations, the temperature of the reaction dispersion during the mixing step and/or optional heating step will be room temperature to about 75 degrees Celsius (° C.). In contrast, in implementations involving polyhydric alcohols, the temperature of the reaction dispersion during the mixing step and/or optional heating step will be anywhere from about 50° C. to about the boiling point of the polyhydric alcohol. More commonly, in these implementations, the reaction dispersion during the mixing step and/or optional heating step will be about 90° C. to about 200° C.

The duration of the mixing step will generally depend on the extent to which the reaction dispersion is mixed and whether the optional heating step is implemented. The upper limit of this duration will be that which is necessary to chemically reduce the desired amount of cationic silver species to metallic silver. In general, the duration of the mixing step will be about 1 minute to about 24 hours. In most implementations, however, the duration of the mixing step will be about 5 minutes to about 3 hours.

Once the mixing step is completed, the metallic silver can be recovered or isolated from the reaction product. The recovery or isolation step can involve the use of a solvent in which metallic silver particles are dispersed and the remaining portion of the reaction product (i.e., any unreacted material and/or reaction byproducts) is dissolved, followed by separating (e.g., by filtering, decanting, or the like) the metallic silver from the solvent having the remaining portion of the reaction product dissolved therein. Suitable solvents for this step will be those in which metallic silver is not soluble and with which metallic silver does not react. One such solvent is water. Once the metallic silver is isolated, the solvent optionally can be treated to recover the components of the reaction product (unreacted material and/or reaction byproducts) dissolved therein.

While the recovery step can be performed just after the mixing step, in implementations of the methods described herein where the reaction dispersion is heated, the recovery step can be performed after the reaction product is cooled to a lower temperature (e.g., to room temperature).

The above described methods, in their various implementations, can be highly efficient. That is, fractional yields for silver in the reaction product of greater than 90 percent (%) are readily achievable. In many implementations, particularly those in which a stoichiometric excess of the organic acid is used, a fractional yield of 100% can be obtained.

Additionally, the metallic silver product that is produced using the above described methods can be highly pure. That is, the recovered or isolated metallic silver will generally have less than 20 ppm of non-silver metals as quantified, for example, by techniques such as inductively coupled plasma-mass spectrometry (ICP-MS). In many implementations, particularly those in which the reaction temperatures and times are longer, and in which the recovery step is more thoroughly performed, the recovered metallic silver will have less than 10 ppm of non-silver metals.

In addition to high purity, the metallic silver exhibits high crystallinity (e.g., as exhibited by powder X-ray diffraction (PXRD)).

The metallic silver particles produced using these methods are generally in the form of agglomerates of fine particles. The agglomeration can enable more easy separation from the solvent used in the recovery or isolation step, but can require a secondary processing step (e.g., grinding, mechanical attrition, or the like) to break down the agglomerates.

The average particle size (which is considered to be the average longest cross-sectional dimension of the fine non-agglomerated particles) of the metallic silver generally is less than or equal to about 1 micrometer. As used herein, the term "longest cross-sectional dimension" refers to the longest cross-sectional dimension of a particle. Thus, to clarify, when a particle is circular, the longest cross-sectional dimension is its diameter; when a particle is oval-shaped, the longest cross-sectional dimension is the longest diameter of the oval; and when a particle is irregularly-shaped, the longest cross-sectional dimension is the line between the two farthest opposing points on the perimeter of the particle. In many implementations, the average particle size of the metallic silver is about 50 nanometers (nm) to about 500 nm.

In one environmentally friendly application of the methods described herein, the source of the silver-containing compound is obtained from an industrial process. Specifically, the silver-containing compound can be a "spent" or "exhausted" silver ion exchange bath, as is used in providing glass and other material surfaces with antimicrobial capabilities. The initial silver ion exchange bath (i.e., before being used to impart the antimicrobial properties to the glass or other materials) can be formed from molten silver nitrate. In certain situations, the initial silver ion exchange bath can be formed from molten silver nitrate and an alkali metal salt (e.g., sodium nitrate, potassium nitrate, potassium phosphate, or the like). Once implemented, the ion exchange bath becomes contaminated with non-silver ionic species (i.e., those ions that are exchanged out from the glass or other material in order to permit silver ions to exchange in). Eventually, the ion exchange baths become too contaminated to be useful for efficient silver ion exchange. Under these circumstances, the silver ion exchange bath is termed "spent" or "exhausted."

In such an application of the methods described herein, the spent silver ion exchange bath, which is a solid monolithic body (when below its melting temperature), can be ground into a powder. An organic acid, in powder form, can be mixed with the spent silver ion exchange bath powder. The powder mixture (containing the spent silver ion exchange bath powder and the organic acid powder) can be disposed in a solvent that is an alcohol. The concentration of the organic acid and the alcohol, collectively, should be about equimolar to, or in a stoichiometric excess of, the concentration of cationic silver species in the silver ion exchange bath powder; and the mass of the alcohol should be less than or equal to the combined mass of the silver ion exchange bath powder and the organic acid. At this point, the reaction dispersion has been formed, and is ready for the mixing step.

In cases where the alcohol is a monohydric alcohol, the mixing step can be conducted at room temperature to about 70° C. In situations where the alcohol is a polyhydric alcohol, the mixing step can be conducted at about 110° C. to about 170° C.

If the temperature of the reaction dispersion was elevated during the mixing step, the reaction product can be cooled to room temperature. Once cooled, or if already at room temperature, the reaction product can be disposed in water to separate the metallic silver from the remainder of the reaction product. Under these conditions, the metallic silver will be dispersed within the water solution, and the remainder of the reaction product will dissolve therein. To facilitate separation of the metallic silver product from the remainder of the reaction product, the solution can be stirred vigorously. At this point, the metallic silver can be recovered from the solution by filtration. Under these conditions, the fractional yield of silver can be greater than about 97%.

In these applications of the methods described herein, the metallic silver product can be highly crystalline. Depending on the level of non-silver cations in the spent ion exchange bath, the metallic silver product can have less than about 200 ppm of non-silver metals. In many circumstances, the metallic silver product can have less than about 50 ppm of non-silver metals. In addition, the average (unagglomerated) particle size of this metallic silver product can be about 120 nm to about 400 nm.

The various embodiments of the present disclosure are further illustrated by the following non-limiting examples.

EXAMPLES

Example 1

In this example, metallic silver powder was fabricated using silver nitrate as the silver-containing compound, ascorbic acid as the organic acid, and ethanol as the solvent.

About 4.0 grams (g) of silver nitrate and about 4.15 g of ascorbic acid were thoroughly mixed in a glass beaker. Subsequently, about 4.0 g of ethanol was added to the beaker, and the contents of the beaker were mixed well. The beaker was placed in an air vented furnace, then heated to, and held at, about 70° C. for about 1 hour with continuous stirring. After about one hour, the dispersion was cooled to room temperature. The grey colored product of the reaction was washed and stirred in deionized (DI) water for about 10 minutes. The remaining solid was separated from the solution by decantation and washed several times with DI water, followed by drying at about 110° C. for about 2 hours. The dried powder was characterized using powder X-ray diffraction (PXRD), inductively coupled plasma-mass spectrometry (ICP-MS), and scanning electron microscopy (SEM) to determine the crystallinity, purity, and particle morphology, respectively, of the product.

Figure 2:
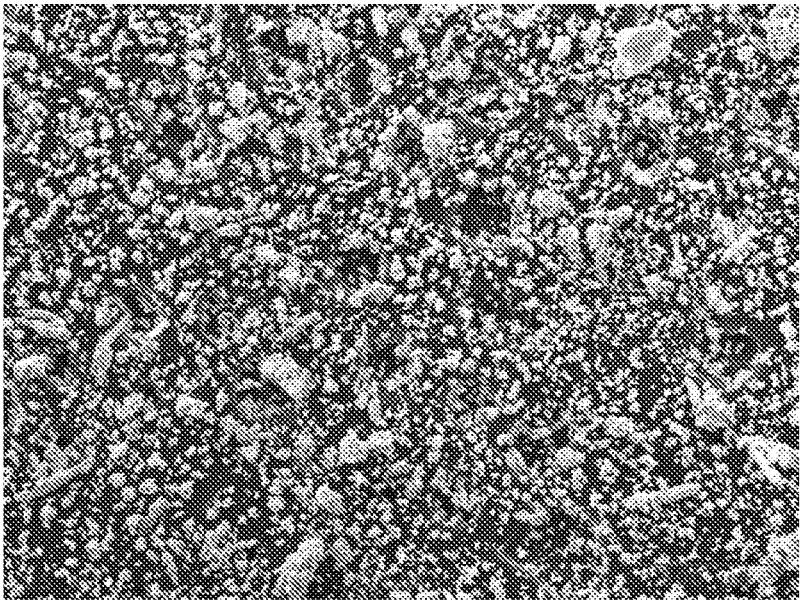
FIG. 2 is a scanning electron microscope image of the silver product produced in accordance with EXAMPLE 1.

FIG. 1 is a PXRD pattern of the dried precipitate product produced in accordance with this example. The pattern shown in FIG. 1 is indicative of a highly-crystalline metallic silver sample. ICP-MS revealed that, other than silver, the sample contained less than 1 part per million (ppm) each of aluminum and calcium, and about 2 ppm each of sodium and potassium. Thus, high purity metallic silver was able to be produced in this example. FIG. 2 is a SEM image of the dried precipitate product produced in accordance with this example. The SEM image of FIG. 2 reveals that there was a significant degree of particle agglomeration in the sample.

Example 2

In this example, metallic silver powder was fabricated using silver nitrate as the silver-containing compound, ascorbic acid as the organic acid, and ethanol as the solvent.

About 4.0 g of silver nitrate and about 4.15 g of ascorbic acid were thoroughly mixed in a glass beaker. Subsequently, about 4.0 g of ethanol was added to the beaker, and the contents of the beaker were mixed well. The contents of the beaker were stirred at room temperature for about 15 minutes. The grey colored product of the reaction was washed and stirred in DI water for about 10 minutes. The remaining solid was separated from the solution by decantation and washed several times with DI water, followed by drying at about 110° C. for about 2 hours. The dried powder was characterized using PXRD, ICP-MS, SEM to determine the crystallinity, purity, and particle morphology, respectively, of the product.

Figure 3:
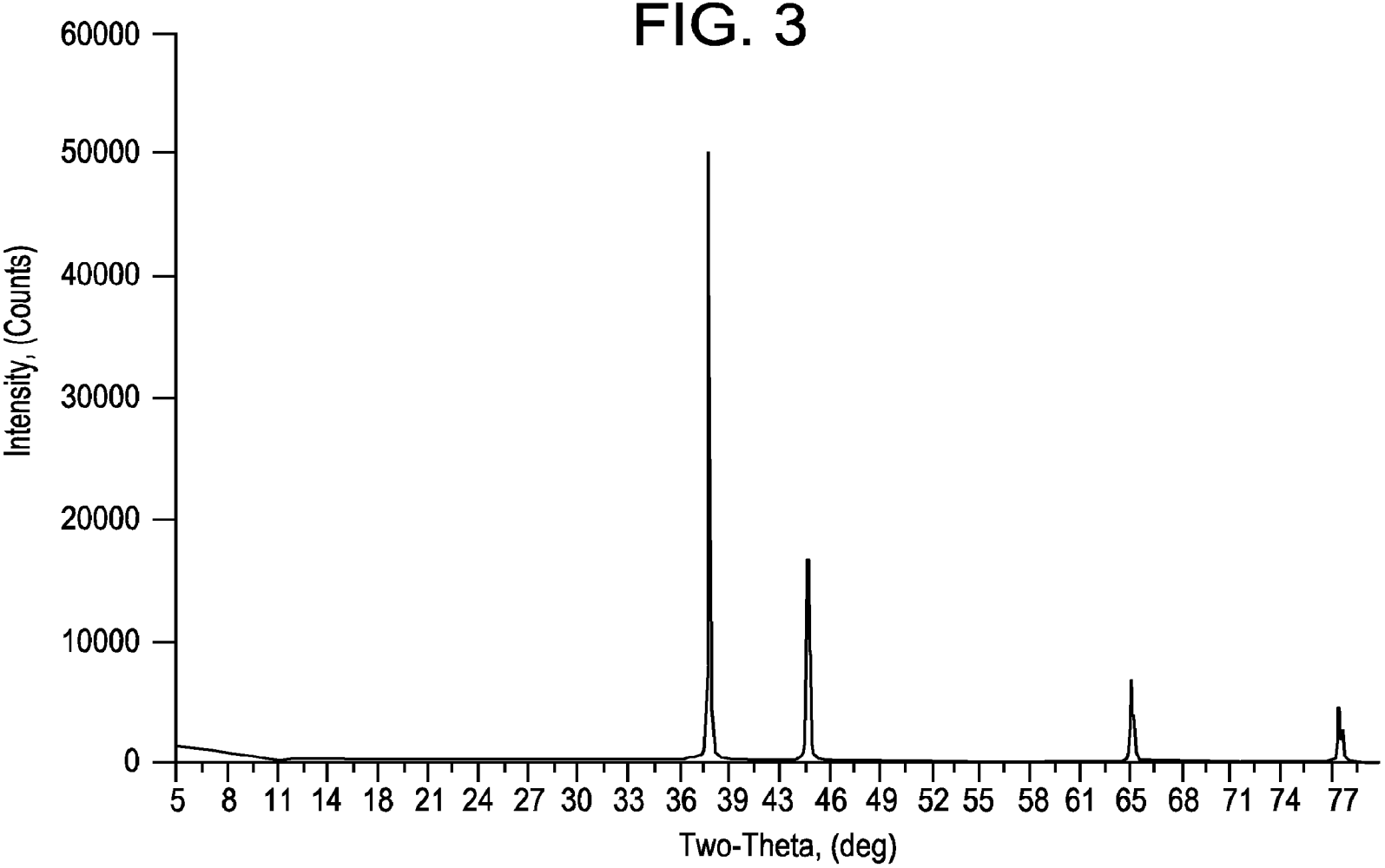
FIG. 3 is a powder X-ray diffraction pattern of the silver product produced in accordance with EXAMPLE 2.
Figure 4:
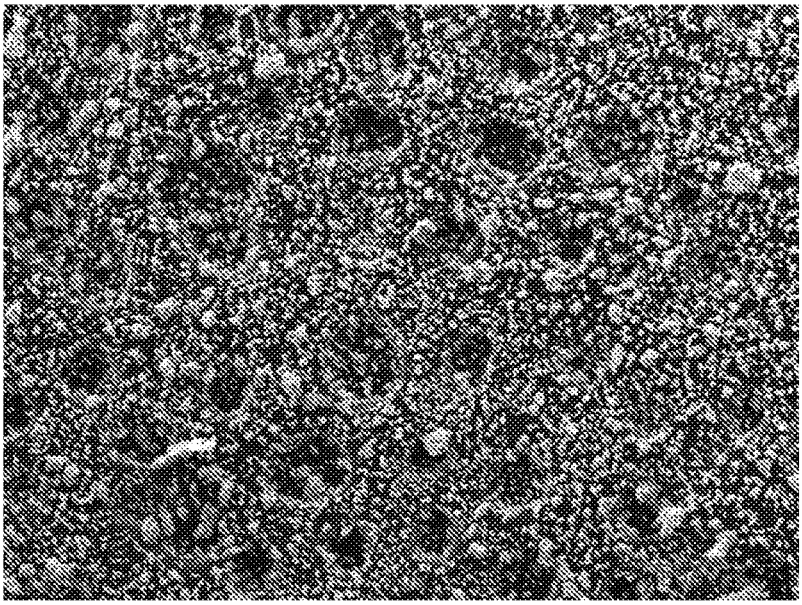
FIG. 4 is a scanning electron microscope image of the silver product produced in accordance with EXAMPLE 2.

FIG. 3 is a PXRD pattern of the dried precipitate product produced in accordance with this example. The pattern shown in FIG. 3 is indicative of a highly-crystalline metallic silver sample. ICP-MS revealed that, other than silver, the sample contained less than 1 ppm each of aluminum and calcium, and about 3 ppm each of sodium and potassium. Thus, high purity metallic silver was able to be produced in this example. FIG. 4 is a SEM image of the dried precipitate product produced in accordance with this example. The SEM image of FIG. 4 reveals that there was a significant degree of particle agglomeration in the sample, but less so than appeared in the sample of EXAMPLE 1.

Example 3

In this example, metallic silver powder was fabricated using silver nitrate as the silver-containing compound, ascorbic acid as the organic acid, and methanol as the solvent.

About 4.0 g of silver nitrate and about 4.15 g of ascorbic acid were thoroughly mixed in a glass beaker. Subsequently, about 4.0 g of methanol was added to the beaker, and the contents of the beaker were mixed well. The contents of the beaker were stirred at room temperature for about 15 minutes. The grey colored product of the reaction was washed and stirred in DI water for about 10 minutes. The remaining solid was separated from the solution by decantation and washed several times with DI water, followed by drying at about 110° C. for about 2 hours. The dried precipitate was characterized using PXRD and ICP-MS to determine the crystallinity and purity, respectively, of the product.

Figure 5:
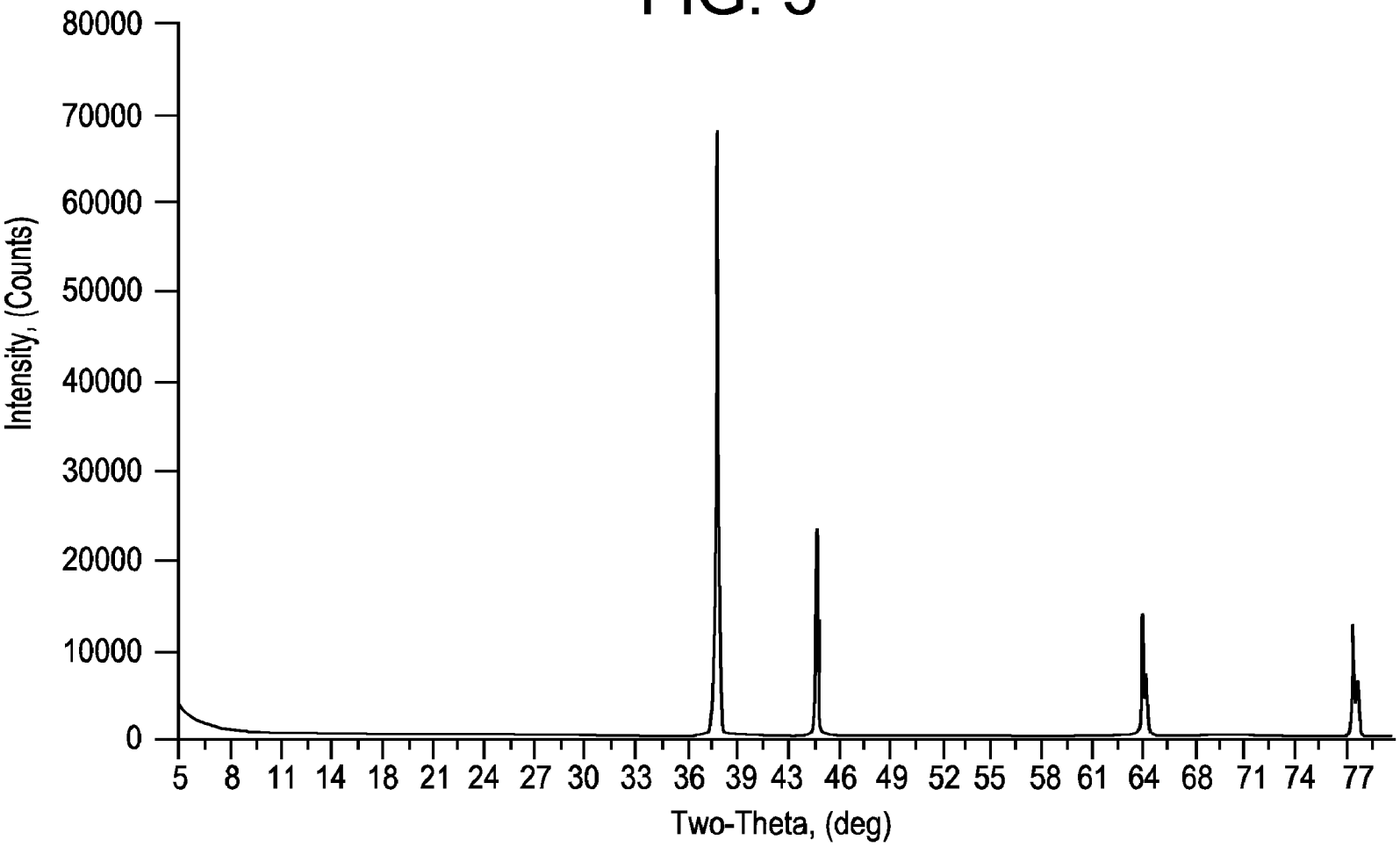
FIG. 5 is a powder X-ray diffraction pattern of the silver product produced in accordance with EXAMPLE 3.

FIG. 5 is a PXRD pattern of the dried precipitate product produced in accordance with this example. The pattern shown in FIG. 5 is indicative of a highly-crystalline metallic silver sample. ICP-MS revealed that, other than silver, the sample contained less than 1 ppm each of aluminum and calcium, and about 2 ppm each of sodium and potassium. Thus, high purity metallic silver was able to be produced in this example.

Example 4

In this example, metallic silver powder was fabricated using silver nitrate as the silver-containing compound, ascorbic acid as the organic acid, and ethanol as the solvent. In addition, sodium nitrate powder, in an amount of 10 weight percent (wt %) based on the weight of the silver nitrate, was added to the silver nitrate powder to evaluate the effect of sodium impurities on the silver reduction reaction.

About 6.0 g of silver nitrate, about 0.6 g sodium nitrate, and about 6.22 g of ascorbic acid were thoroughly mixed in a glass beaker. Subsequently, about 6.0 g of ethanol was added to the beaker, and the contents of the beaker were mixed well. The contents of the beaker were stirred at room temperature for about 15 minutes. The grey colored product of the reaction was washed and stirred in DI water for about 10 minutes. The remaining solid was separated from the solution by decantation and washed several times with DI water, followed by drying at about 110° C. for about 2 hours. The dried precipitate was characterized using PXRD and ICP-MS to determine the crystallinity and purity, respectively, of the product.

Figure 6:
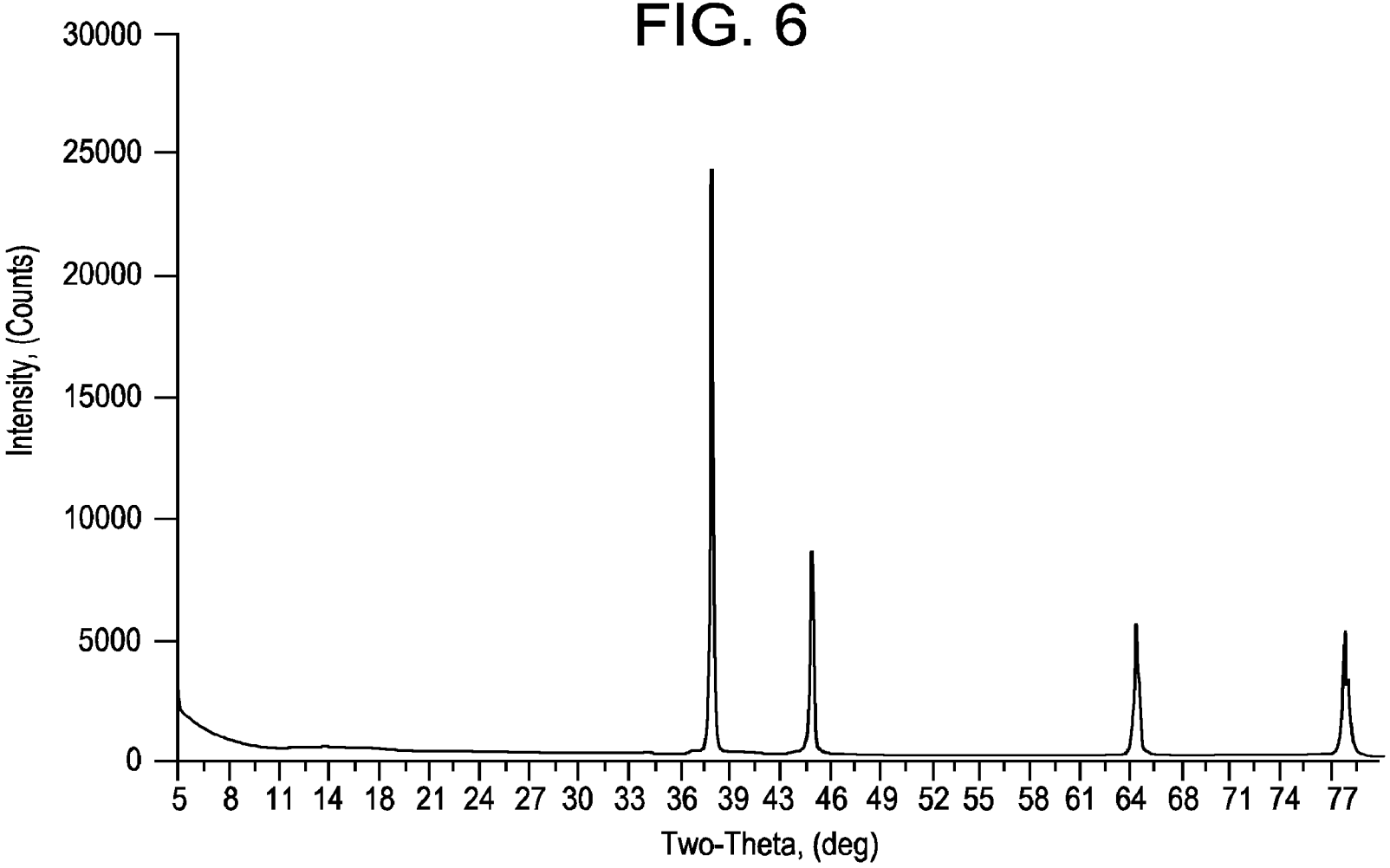
FIG. 6 is a powder X-ray diffraction pattern of the silver product produced in accordance with EXAMPLE 4.

FIG. 6 is a PXRD pattern of the dried precipitate product produced in accordance with this example. The pattern shown in FIG. 6 is indicative of a highly-crystalline metallic silver sample. ICP-MS revealed that, other than silver, the sample contained less than 1 ppm each of aluminum and calcium, about 15 ppm of sodium, and about 4 ppm of potassium. Thus, high purity metallic silver was able to be produced in this example.

Example 5

In this example, metallic silver powder was fabricated using silver nitrate as the silver-containing compound, ascorbic acid as the organic acid, and ethanol as the solvent. In contrast to EXAMPLES 1-4 above, however, where the silver nitrate was a commercially purchased powder, the source of the silver nitrate in this example was a spent solid silver ion exchange bath that had an initial composition of about 50 wt % silver nitrate and about 50 wt % potassium phosphate.

First, the solid sample was crushed and ground into powder. Next, about 12 g of the powdered sample and about 6.22 g of ascorbic acid were thoroughly mixed in a glass beaker. Subsequently, about 12.0 g of ethanol was added to the beaker, and the contents of the beaker were mixed well. The contents of the beaker were stirred at room temperature for about 15 minutes. The grey colored product of the reaction was washed and stirred in DI water for about 10 minutes. The remaining solid was separated from the solution by decantation and washed several times with DI water, followed by drying at about 110° C. for about 2 hours. The dried precipitate was characterized using PXRD and ICP-MS to determine the crystallinity and purity, respectively, of the product.

Figure 7:
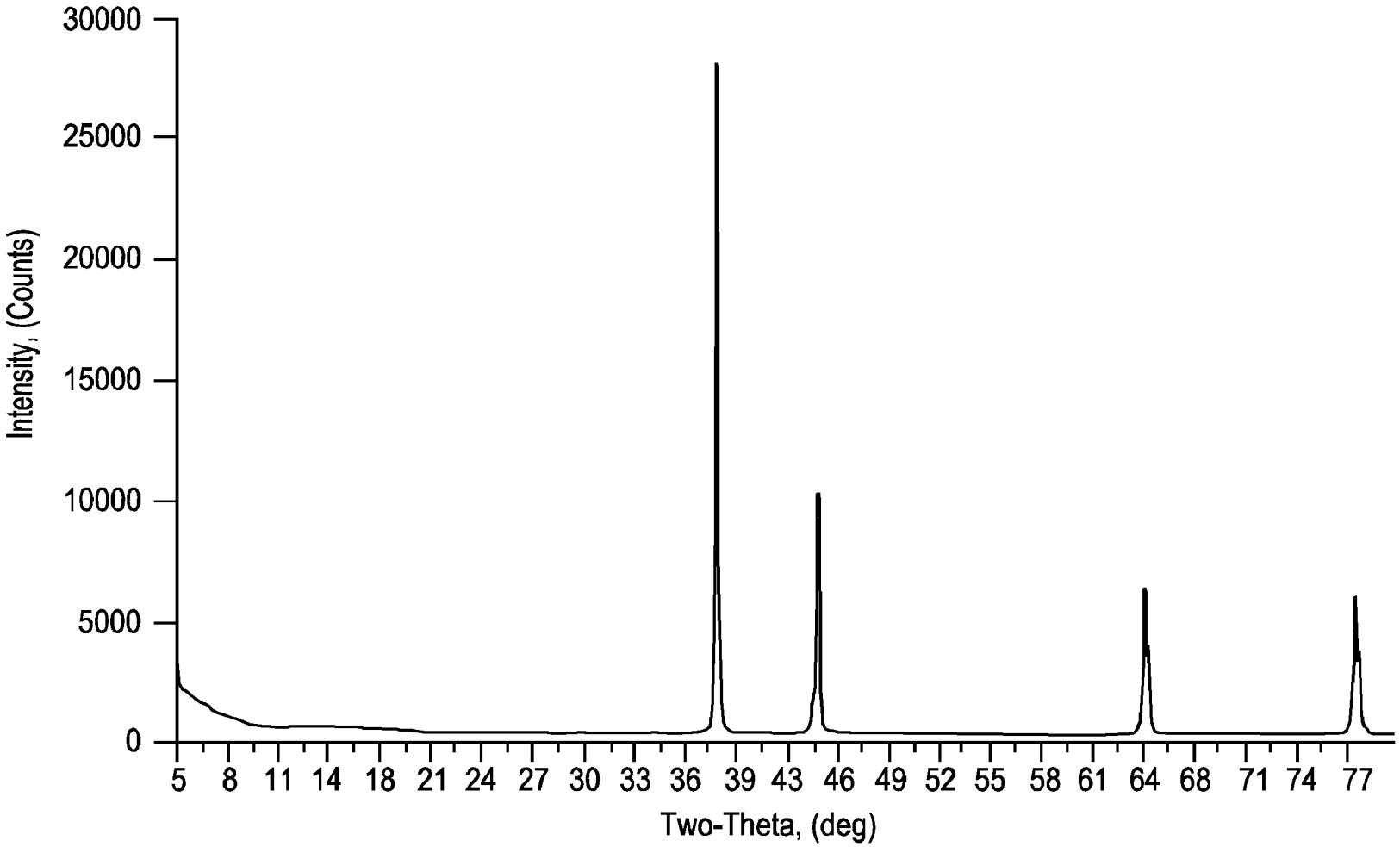
FIG. 7 is a powder X-ray diffraction pattern of the silver product produced in accordance with EXAMPLE 5.

FIG. 7 is a PXRD pattern of the dried precipitate product produced in accordance with this example. The pattern shown in FIG. 7 is indicative of a highly-crystalline metallic silver sample. ICP-MS revealed that, other than silver, the sample contained less than 1 ppm each of aluminum and calcium, about 2 ppm of sodium, and about 39 ppm of potassium. Thus, high purity metallic silver was able to be produced in this example.

Example 6

In this example, metallic silver powder was fabricated using silver nitrate as the silver-containing compound, oxalic acid as the organic acid, and glycerol as the solvent.

About 4.0 g of silver nitrate and about 1.06 g of oxalic acid were thoroughly mixed in a glass beaker. Subsequently, about 2.0 g of glycerol was added to the beaker, and the contents of the beaker were mixed well. The beaker was placed in an air vented furnace, then heated to, and held at, about 170° C. for about 1 hour. After about one hour, the dispersion was cooled to room temperature. The grey colored product of the reaction was washed and stirred in DI water for about 10 minutes. The remaining solid was separated from the solution by decantation and washed several times with DI water, followed by drying at about 110° C. for about 2 hours. The dried powder was characterized using PXRD, ICP-MS, SEM to determine the crystallinity, purity, and particle morphology, respectively, of the product.

Figure 8:
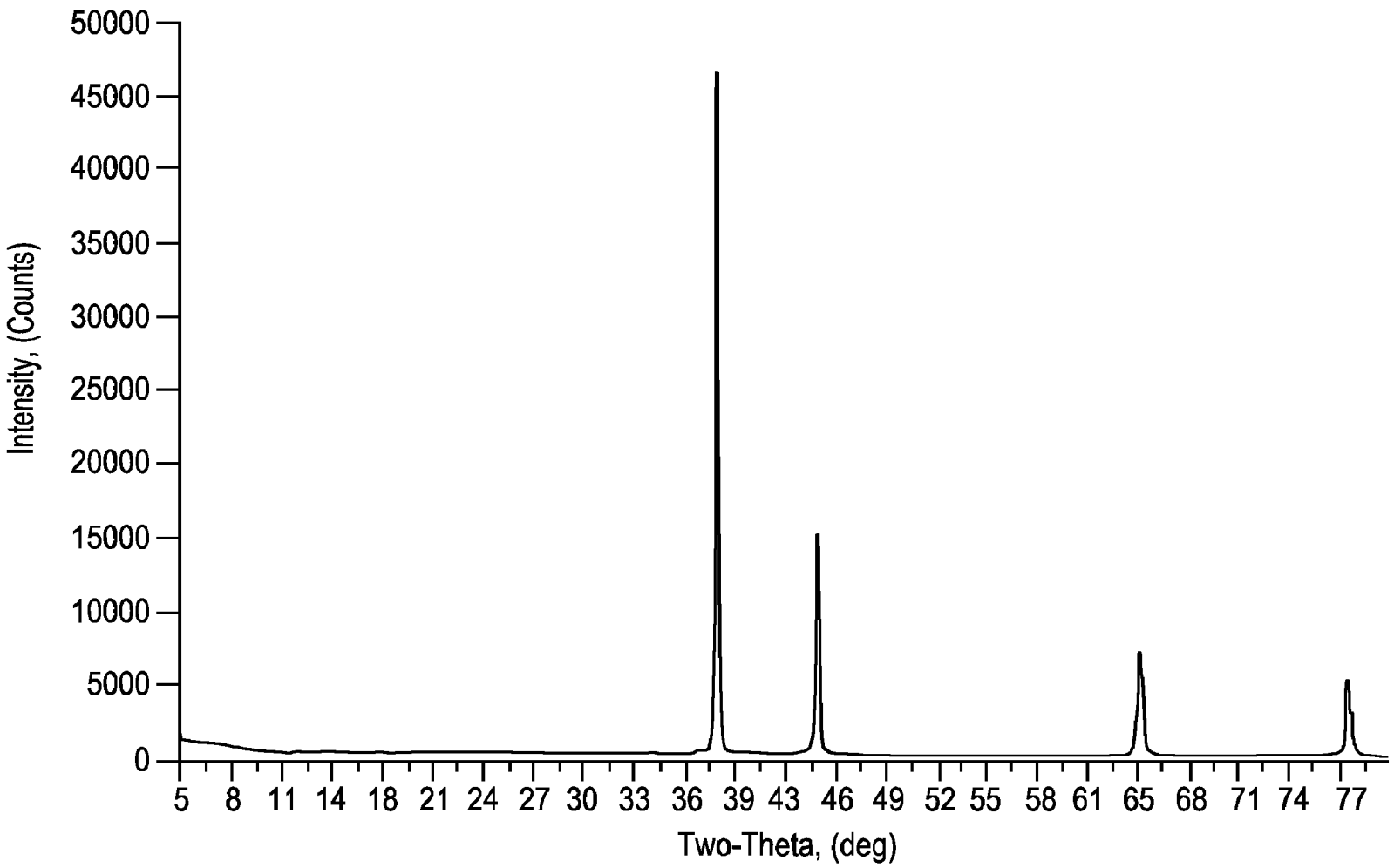
FIG. 8 is a powder X-ray diffraction pattern of the silver product produced in accordance with EXAMPLE 6.
Figure 9:
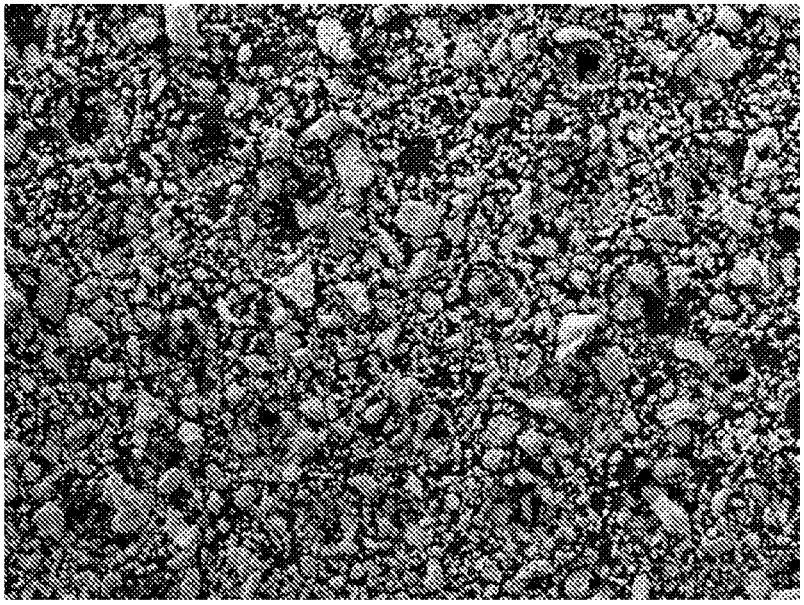
FIG. 9 is a scanning electron microscope image of the silver product produced in accordance with EXAMPLE 6.

FIG. 8 is a PXRD pattern of the dried precipitate product produced in accordance with this example. The pattern shown in FIG. 8 is indicative of a highly-crystalline metallic silver sample. ICP-MS revealed that, other than silver, the sample contained less than 1 ppm of calcium, and less than 2 ppm each of sodium, potassium, and aluminum. Thus, high purity metallic silver was able to be produced in this example. FIG. 9 is a SEM image of the dried precipitate product produced in accordance with this example. The SEM image of FIG. 9 reveals that there was a significant degree of particle agglomeration in the sample.

Example 7

In this example, metallic silver powder was fabricated using silver nitrate as the silver-containing compound, oxalic acid as the organic acid, and glycerol as the solvent.

About 4.0 g of silver nitrate and about 1.06 g of oxalic acid were thoroughly mixed in a glass beaker. Subsequently, about 2.0 g of glycerol was added to the beaker, and the contents of the beaker were mixed well. The beaker was placed in an air vented furnace, then heated to, and held at, about 150° C. for about 1 hour. After about one hour, the dispersion was cooled to room temperature. The grey colored product of the reaction was washed and stirred in DI water for about 10 minutes. The remaining solid was separated from the solution by decantation and washed several times with DI water, followed by drying at about 110° C. for about 2 hours. The dried powder was characterized using PXRD, ICP-MS, SEM to determine the crystallinity, purity, and particle morphology, respectively, of the product.

Figure 10:
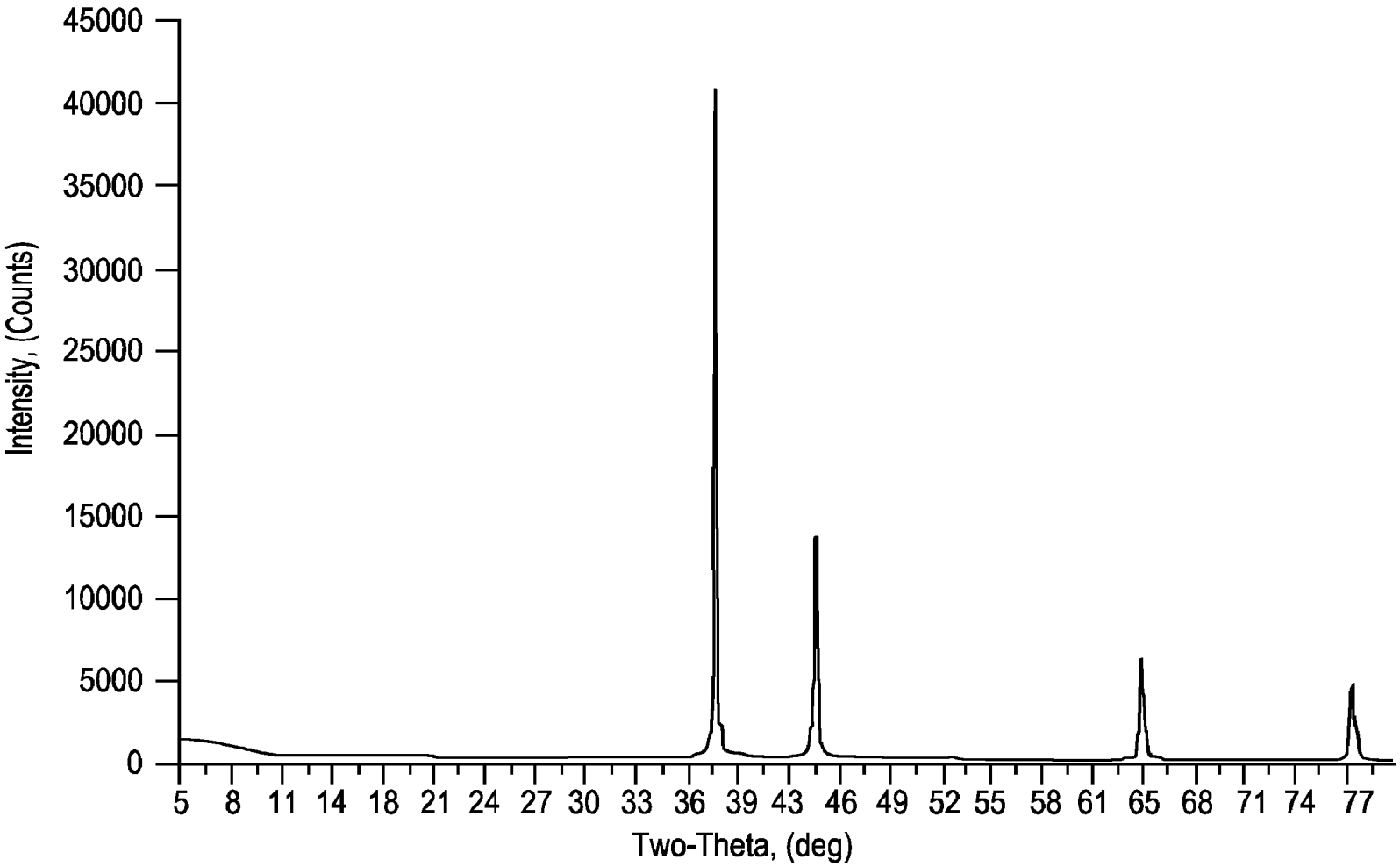
FIG. 10 is a powder X-ray diffraction pattern of the silver product produced in accordance with EXAMPLE 7.
Figure 11:
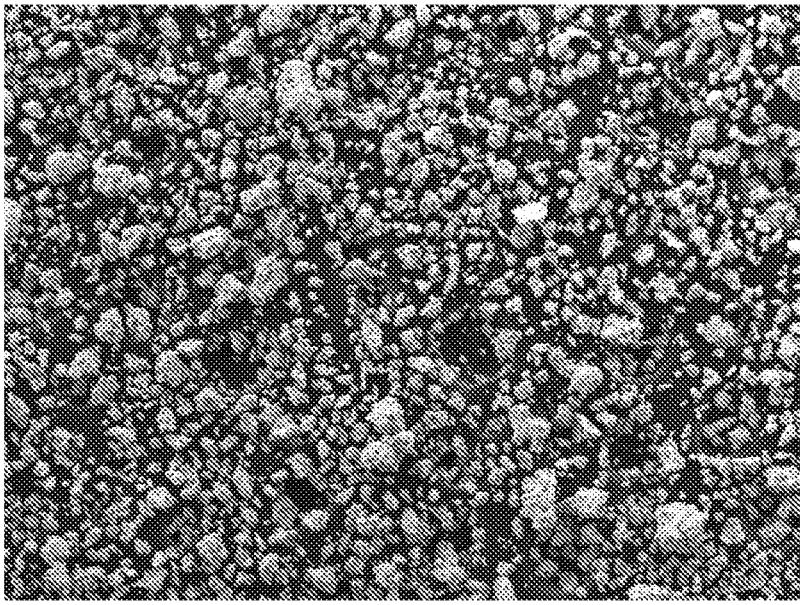
FIG. 11 is a scanning electron microscope image of the silver product produced in accordance with EXAMPLE 7.

FIG. 10 is a PXRD pattern of the dried precipitate product produced in accordance with this example. The pattern shown in FIG. 10 is indicative of a highly-crystalline metallic silver sample. ICP-MS revealed that, other than silver, the sample contained less than 1 ppm of calcium, and less than 2 ppm each of sodium, potassium, and aluminum. Thus, high purity metallic silver was able to be produced in this example. FIG. 11 is a SEM image of the dried precipitate product produced in accordance with this example. The SEM image of FIG. 11 reveals that there was a significant degree of particle agglomeration in the sample.

Example 8

In this example, metallic silver powder was fabricated using silver nitrate as the silver-containing compound, oxalic acid as the organic acid, and glycerol as the solvent.

About 4.0 g of silver nitrate and about 1.06 g of oxalic acid were thoroughly mixed in a glass beaker. Subsequently, about 2.0 g of glycerol was added to the beaker, and the contents of the beaker were mixed well. The beaker was placed in an air vented furnace, then heated to, and held at, about 110° C. for about 1 hour. After about one hour, the dispersion was cooled to room temperature. The grey colored product of the reaction was washed and stirred in DI water for about 10 minutes. The remaining solid was separated from the solution by decantation and washed several times with DI water, followed by drying at about 110° C. for about 2 hours. The dried powder was characterized using PXRD, ICP-MS, SEM to determine the crystallinity, purity, and particle morphology, respectively, of the product.

Figure 12:
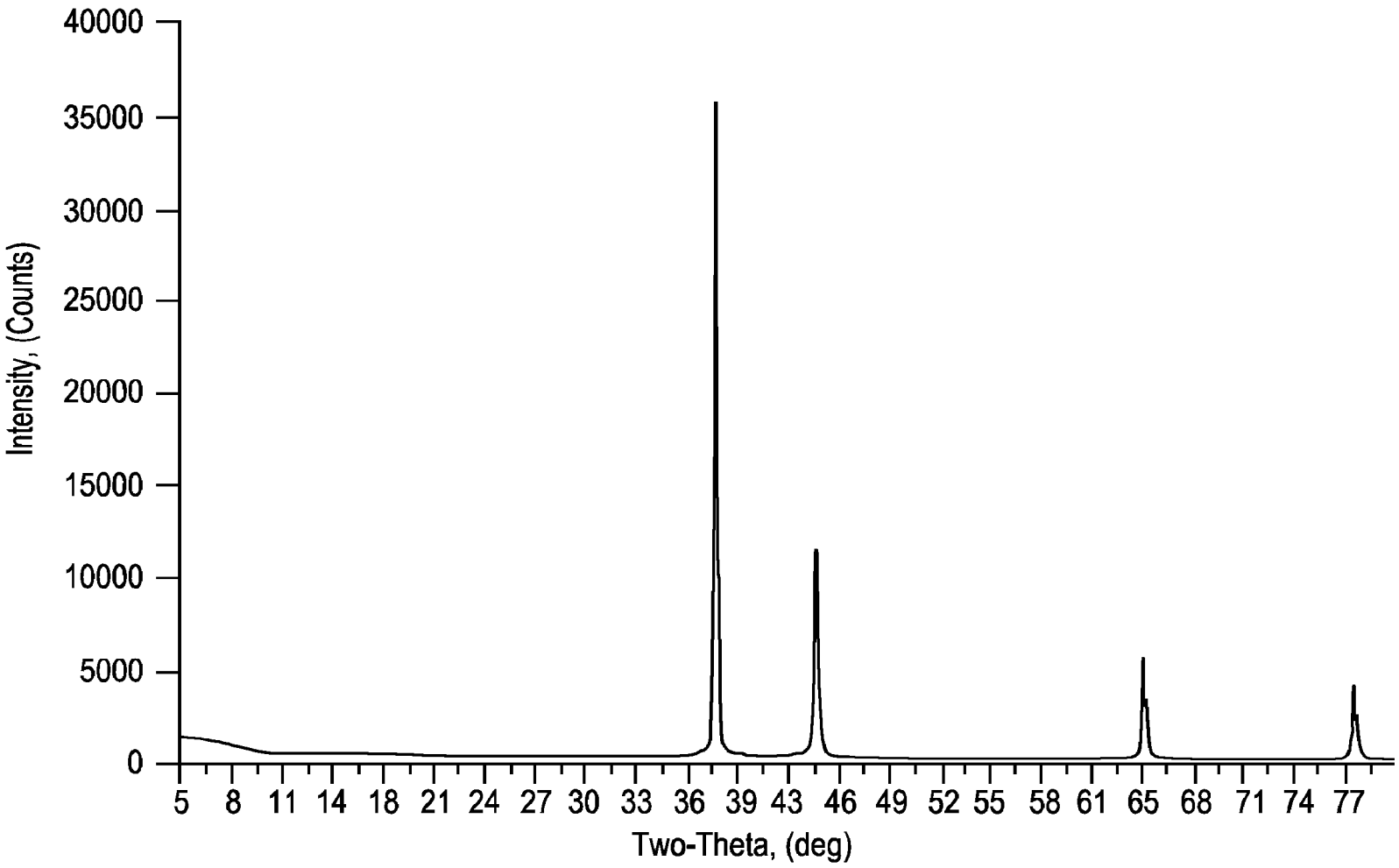
FIG. 12 is a powder X-ray diffraction pattern of the silver product produced in accordance with EXAMPLE 8.
Figure 13:
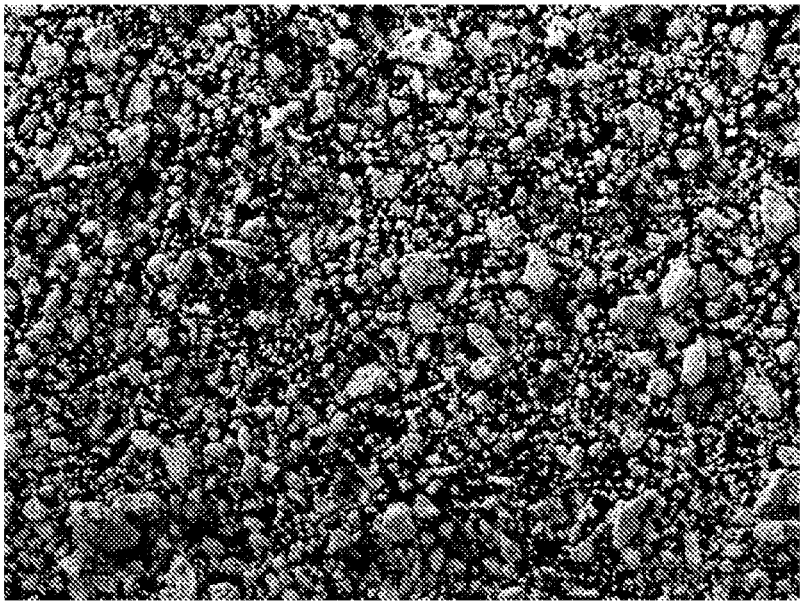
FIG. 13 is a scanning electron microscope image of the silver product produced in accordance with EXAMPLE 8.

FIG. 12 is a PXRD pattern of the dried precipitate product produced in accordance with this example. The pattern shown in FIG. 12 is indicative of a highly-crystalline metallic silver sample. ICP-MS revealed that, other than silver, the sample contained less than 1 ppm of calcium, and less than 2 ppm each of sodium, potassium, and aluminum. Thus, high purity metallic silver was able to be produced in this example. FIG. 13 is a SEM image of the dried precipitate product produced in accordance with this example. The SEM image of FIG. 13 reveals that there was a significant degree of particle agglomeration in the sample.

Example 9

In this example, metallic silver powder was fabricated using silver nitrate as the silver-containing compound, ascorbic acid as the organic acid, and glycerol as the solvent. In addition, sodium nitrate powder, in an amount of 10 wt % based on the weight of the silver nitrate, was added to the silver nitrate powder to evaluate the effect of sodium impurities on the silver reduction reaction.

About 6.0 g of silver nitrate, about 0.6 g sodium nitrate, and about 6.08 g of ascorbic acid were thoroughly mixed in a glass beaker. Subsequently, about 4.0 g of glycerol was added to the beaker, and the contents of the beaker were mixed well. The beaker was placed in an air vented furnace, then heated to, and held at, about 110° C. for about 90 minutes. After about 90 minutes, the dispersion was cooled to room temperature. The grey colored product of the reaction was washed and stirred in DI water for about 10 minutes. The remaining solid was separated from the solution by decantation and washed several times with DI water, followed by drying at about 110° C. for about 2 hours. The dried precipitate was characterized using PXRD and ICP-MS to determine the crystallinity and purity, respectively, of the product.

Figure 14:
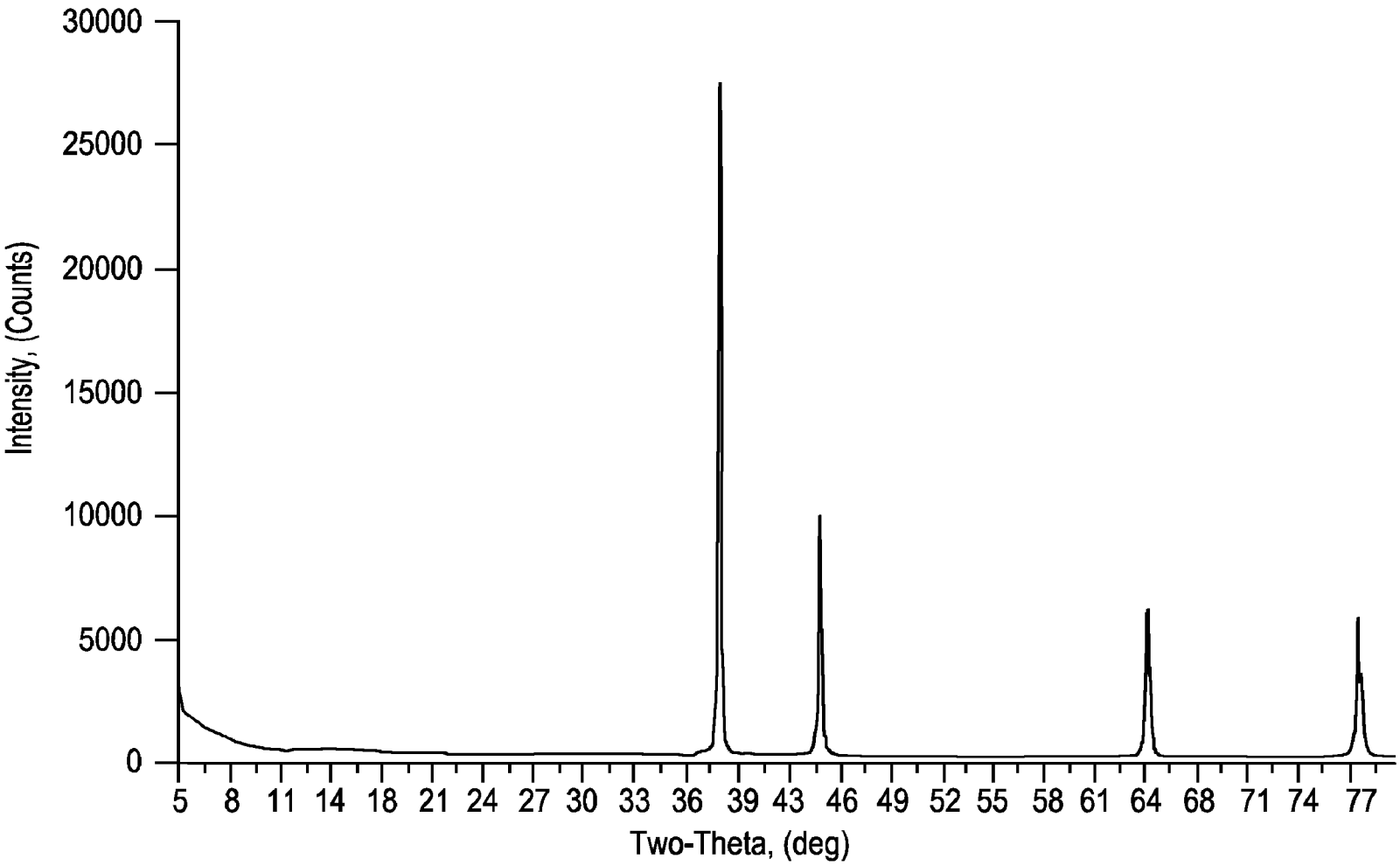
FIG. 14 is a powder X-ray diffraction pattern of the silver product produced in accordance with EXAMPLE 9.

FIG. 14 is a PXRD pattern of the dried precipitate product produced in accordance with this example. The pattern shown in FIG. 14 is indicative of a highly-crystalline metallic silver sample. ICP-MS revealed that, other than silver, the sample contained less than 1 ppm each of calcium, less than 2 ppm of aluminum, and about 4 ppm each of sodium and potassium. Thus, high purity metallic silver was able to be produced in this example.

Example 10

In this example, metallic silver powder was fabricated using silver nitrate as the silver-containing compound, ascorbic acid as the organic acid, and glycerol as the solvent. In contrast to EXAMPLES 6-9 above, however, where the silver nitrate was a commercially purchased powder, the source of the silver nitrate in this example was a spent solid silver ion exchange bath that had an initial composition of about 50 wt % silver nitrate and about 50 wt % potassium phosphate.

First, the solid sample was crushed and ground into powder. Next, about 12 g of the powdered sample and about 6.08 g of ascorbic acid were thoroughly mixed in a glass beaker. Subsequently, about 6.0 g of glycerol was added to the beaker, and the contents of the beaker were mixed well. The beaker was placed in an air vented furnace, then heated to, and held at, about 110° C. for about 60 minutes. After about one hour, the dispersion was cooled to room temperature. The grey colored product of the reaction was washed and stirred in DI water for about 10 minutes. The remaining solid was separated from the solution by decantation and washed several times with DI water, followed by drying at about 110° C. for about 2 hours. The dried precipitate was characterized using PXRD and ICP-MS to determine the crystallinity and purity, respectively, of the product.

Figure 15:
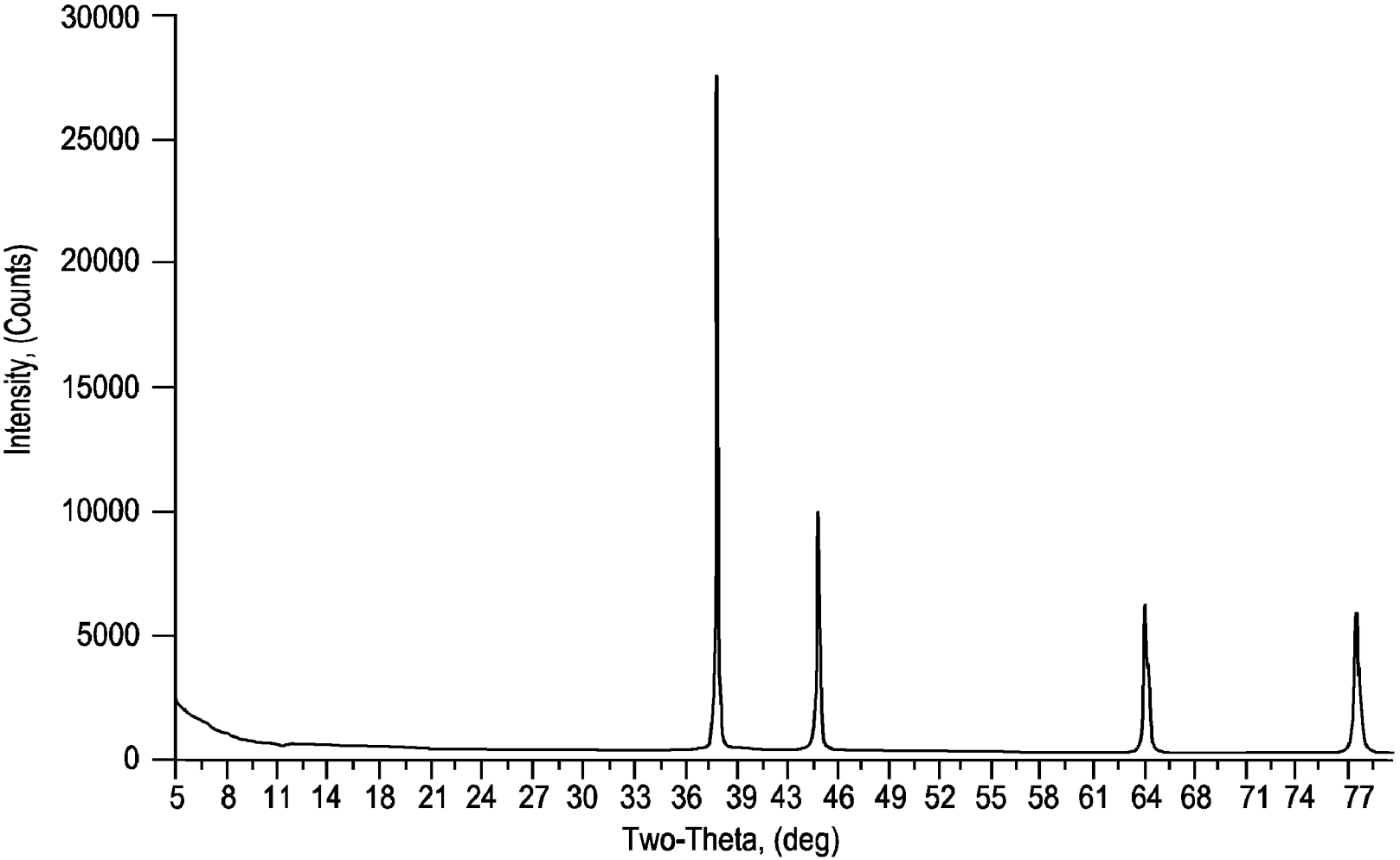
FIG. 15 is a powder X-ray diffraction pattern of the silver product produced in accordance with EXAMPLE 10.

FIG. 15 is a PXRD pattern of the dried precipitate product produced in accordance with this example. The pattern shown in FIG. 15 is indicative of a highly-crystalline metallic silver sample. ICP-MS revealed that, other than silver, the sample contained less than 1 ppm of calcium, about 5 ppm of aluminum, about 2 ppm of sodium, and about 160 ppm of potassium. Thus, high purity metallic silver was able to be produced in this example.

As can be seen from the above description and examples, the methods described herein are useful, especially in the area of powder metallurgy, as a result of their simplicity, economic character, and ability to be industrially scaled-up.

While the embodiments disclosed herein have been set forth for the purpose of illustration, the foregoing description should not be deemed to be a limitation on the scope of the disclosure or the appended claims. Accordingly, various modifications, adaptations, and alternatives may occur to one skilled in the art without departing from the spirit and scope of the present disclosure or the appended claims.

What is claimed is:

1. A method for making metallic silver, the method comprising:

disposing a silver-containing compound and an organic acid in a solvent comprising an alcohol to form a reaction dispersion, wherein a concentration of the organic acid and alcohol is equimolar to or in a stoichiometric excess of a concentration of a cationic silver species in the silver-containing compound, and wherein a mass of the solvent in the reaction dispersion is less than or equal to a combined mass of the silver-containing compound and the organic acid;

mixing the reaction dispersion for a time effective to produce a reaction product comprising metallic silver from the cationic silver species of the silver-containing compound; and optionally, heating the reaction dispersion.

2. The method of claim 1, wherein the silver-containing compound comprises silver nitrate, silver nitrite, silver oxide, silver sulfate, silver phosphate, a silver halide, or a mixture thereof.

3. The method of claim 1, wherein the organic acid comprises lactic acid, citric acid, oxalic acid, ascorbic acid, fumaric acid, maleic acid, or a mixture thereof.

4. The method of claim 1, wherein the alcohol is a monohydric alcohol.

5. The method of claim 4, wherein the mixing is conducted at room temperature, and the reaction dispersion is not heated.

6. The method of claim 4, wherein the heating occurs during the mixing, and the reaction dispersion is heated to a temperature of less than or equal to a boiling temperature of the monohydric alcohol.

7. The method of claim 1, wherein the alcohol is a polyhydric alcohol.

8. The method of claim 7, wherein the heating occurs during the mixing, and the reaction dispersion is heated to a temperature of less than or equal to a boiling temperature of the polyhydric alcohol.

9. The method of claim 1, wherein the heating occurs after the mixing, and the reaction dispersion is heated to a temperature of less than or equal to a boiling temperature of the alcohol.

10. The method of claim 1, wherein the time of the mixing is about 5 minutes to about 3 hours.

11. The method of claim 1, further comprising recovering the metallic silver from the reaction product.

12. The method of claim 11, wherein the recovering comprises:

disposing the reaction product in a solvent, wherein the metallic silver is dispersed in the solvent and a remaining portion of the reaction product is dissolved in the solvent; and separating the metallic silver from the solvent with the remaining portion of the reaction product dissolved therein.

13. The method of claim 11, further comprising cooling the reaction product before recovering the metallic silver from the reaction product.

14. The method of claim 1, wherein the metallic silver is produced in a fractional yield of greater than 90 percent.

15. A method for making metallic silver, the method comprising:

disposing a silver-containing compound and an organic acid in an alcohol to form a reaction dispersion, wherein a concentration of the organic acid and alcohol is equimolar to or in a stoichiometric excess of a concentration of a cationic silver species in the silver-containing compound, and wherein a mass of the alcohol in the reaction dispersion is less than or equal to a combined mass of the silver-containing compound and the organic acid;

mixing the reaction dispersion for a time effective to produce a reaction product comprising metallic silver from the cationic silver species of the silver-containing compound;

disposing the reaction product in a solvent, wherein the metallic silver is dispersed in the solvent and a remaining portion of the cooled reaction product is dissolved in the solvent; and separating the metallic silver from the solvent with the remaining portion of the reaction product dissolved therein.

16. The method of claim 15, wherein the silver-containing compound is silver nitrate, the organic acid is ascorbic acid, the alcohol is a monohydric alcohol, and the mixing is conducted at room temperature.

* * * * *